United States Patent [19]

Terwilliger et al.

[11] 4,046,576

[45] Sept. 6, 1977

[54] PROCESS FOR PREPARING SILVER HALIDE EMULSION USING A SULFUR-CONTAINING RIPENING AGENT

[75] Inventors: James P. Terwilliger; Anthony D. Gingello; Jong-Shinn Wey, all of Rochester, N.Y.

[73] Assignee: Eastman Kodak Company, Rochester, N.Y.

[21] Appl. No.: 693,445

[22] Filed: June 7, 1976

[51] Int. Cl.[2] ..... G03C 1/02; G03C 1/28

[52] U.S. Cl. ..... 96/108; 96/107; 96/94 R

[58] Field of Search ..... 96/94 R, 107, 108

[56] References Cited

U.S. PATENT DOCUMENTS

| | | | |
|---|---|---|---|
| 3,271,157 | 9/1966 | McBride | 96/107 |
| 3,320,069 | 5/1967 | Illingsworth | 96/107 |
| 3,519,426 | 7/1970 | Halwig | 96/94 R |
| 3,773,516 | 11/1973 | Gutoff | 96/94 R |

OTHER PUBLICATIONS

Photographic Science and Engr., "Nucleation and Crystal Growth Rates During Precipitation of Silver Halide Photographic Emulsions", vol. 14, No. 4, July--Aug., 1970.

Photographic Science and Engr., "Ammoniacal Emulsions, vol. 15, No. 3, May-June, 1971.

Zelikman, et al., "Making and Coating Photographic Emulsions," Focal Press, pp. 228-234.

M. A. Larson, et al., Crystal Size Distributions from Multistage Crystallizers," Chem. Engr. Progress Symposium Series, 67, No. 110, 97-107, 1971.

*Primary Examiner*—Won H. Louie, Jr.

*Attorney, Agent, or Firm*—Carl O. Thomas

[57] ABSTRACT

A process is disclosed for the continuous formation of radiation-sensitive silver halide emulsions. In the course of reacting a silver salt with a halide salt in the presence of a peptizer to form a radiation-sensitive silver halide emulsion a portion of the emulsion is withdrawn continuously from the reaction chamber while silver halide grain formation is occurring. The silver halide grains are formed in the presence of a sulfur-containing silver halide ripening agent, while the total halide ion concentration is concurrently controlled and maintained at less than 0.01 molar.

19 Claims, No Drawings

PROCESS FOR PREPARING SILVER HALIDE EMULSION USING A SULFUR-CONTAINING RIPENING AGENT

This invention is directed to a process of preparing a silver halide emulsion wherein emulsion is withdrawn continuously from a reaction chamber while silver halide grain formation is occurring. More specifically, this invention is directed to such as process of preparing silver halide grains wherein the total halide ion concentration and ripening of the silver halide grains is being controlled.

The batch preparation or radiation-sensitive silver halide emulsions is old and well known in the art. To form a radiation-sensitive silver halide emulsion a silver salt is reacted with at least one halide salt in the presence of a peptizer. In one approach, referred to in the art as a single-jet precipitation technique, one reactant (usually the halide salt) and at least a portion of the peptizer are loaded into a reaction chamber and the other salt (usually the silver salt) is introduced in a single jet. In an alternative approach, referred to in the art as a double-jet precipitation technique, the silver and the halide salts are introduced concurrently into the reaction chamber in separate jets. Such parameters as desired cystal habit and size-frequency distribution of the silver halide grains affect the specific silver halide precipitation techniques to be employed.

Although radiation-sensitive silver halide emulsions are most commonly prepared by either single-jet or double-jet batch precipitation processes, it is known that radiation-sensitive silver halide emulsions can be prepared by continuous silver halide precipitation techniques. A continuous silver halide emulsion forming technique can be viewed as a modified form of a double-jet batch precipitation technique wherein a portion of the silver halide emulsion is removed while silver halide grain formation is still occurring. Typically a continuous precipitation technique is performed under steady-state conditions wherein the rate of removal of silver halide grains and peptizer from a reaction chamber balances the rates of reactant and peptizer additions. The emulsion withdrawn from the reaction chamber is a polydispersed emulsion, since the silver halide grains differ as to their individual residence times within the reaction chamber. However, an invariant output in terms of average grain size, crystal habit and size-frequency distribution is obtainable under steady state operating conditions. Illustrations of conventional continuous silver halide emulsion forming techniques are provided by Halwig U.S. Pat. No. 3,519,426, issued July 7, 1970, and Zelikman and Levi, *Making and Coating Photographic Emulsions*, Focal Press, pp. 228–234. It is to be particularly noted that Zelikman and Levi at page 228, FIG. 122, suggest two stage, or cascade, continuous silver halide emulsion formation. (A discussion of cascade crystallization not related to silver halide compositions is given by M. A. Larson and P. R. Wolff, *Crystal Size Distributions from Multistage Crystallizers*, Chemical Engineering Progress Symposium Series, 67, No. 110, 97–107, 1971).

Gutoff in U.S. Pat. No. 3,773,516, issued Nov. 20, 1973, discloses a continuous silver halide precipitation technique whereby larger silver halide grains, from about 0.5 to 1.1 microns in diameter, can be produced with lower reaction chamber residence times, less than 8 minutes. To accomplish this Gutoff precipitates the silver halide grains in the presence of ammonia. Gutoff teaches that at a temperature of about 60° C and an ammonia concentration of 0.66 N, with a pBr of 1.0 to 1.4, octrahedral grains are formed; and at pBr values above 1.6 cubic grains are formed. Gutoff does not disclose using pBr values in excess of 1.9—i.e., a bromide ion concentration of less than $1.25 \times 10^{-2}$(0.0125) molar. Gutoff states that in the absence of ammonia, uniform crystal habits may be achieved only at lower bromide ion concentrations, which are difficult to control. Gutoff has additionally published two articles which, to the extent pertinent, are considered generally cumulative with the above patent. These are "Nucleation and Crystal Growth Rates During Precipitation of Silver Halide Photographic Emulsions", *Photographic Science and Engineering*, Vol. 14, No. 4, July-August 1970, and a smiliarly titled article, sub-titled "II. Ammoniacal Emulsions", appearing in the same journal, Volume 15, No. 3, May-June 1971.

In one aspect, the present invention is directed to a process of continuously preparing a radiation-sensitive silver halide emulsion wherein (1) a silver salt and a halide salt capable of reacting to form radiation-sensitive silver halide grains are concurrently and separately introduced continuously into a reaction chamber in the presence of a peptizer and (2) radiation-sensitive silver halide emulsion is withdrawn continuously from the reaction chamber while silver halide grain formation is occurring. The invention comprises the improvement of forming the silver halide grains in the presence of a sulfur-containing silver halide grain ripening agent and concurrently controlling and maintaining the total halide ion concentration within the reaction chamber at less than 0.010 molar.

The present invention process offers several unexpected advantages over conventional continuous silver halide precipitation processes. Specifically, we have discovered a process of continuously forming radiation-sensitive silver halide, e.g. silver bromide and silver bromoiodide grains, in the presence of a ripening agent at reduced total halide ion concentrations. We have discovered a process which permits increasing the average silver halide grain size for a given average reaction chamber residence time using total halide ion concentrations nearer reactant equivalance concentrations than have been heretofore taught for continuous precipitation of silver halide grains in the presence of a ripening agent. Our process further permits greater control over silver halide grain size and shape. By precipitating silver halide grains at lower total halide ion concentrations we are able to form silver halide emulsions which are less susceptible to variations in grain size attributable to physical ripening during subsequent processing. Further, we have produced silver halide emulsions according to our invention which can be of higher contrast and higher speed than continuously formed ammoniacal silver halide emulsions. Still further, the emulsions of our process produce higher speed emulsions than continuously formed ammoniacal silver halide emulsions when both are optimally chemically sensitized, as with sulfur and gold sensitizers. Additionally, the emulsions formed according to our process exhibit lower fog levels than comparably formed ammoniacal silver halide emulsions. It is still another advantage of our process that it is capable of producing thioether ripended silver halide emulsions in a controlled manner of varied grain shapes, such as regular cubic and octahedral grain shapes, and, in one specific preferred form, large cubic grain emulsions. Other specific advantages of our process will become apparent in considering the detailed description of our invention which follows.

In practicing our process a silver halide grain peptizer, a silver salt and at least one halide salt are concurrently introduced into a reaction chamber according to procedures which are conventional for double-jet batch precipitations of silver halide emulsions. The silver salt and the halide salt or salts are separately introduced into the reaction chamber. The reaction medium is typically an aqueous medium, and water soluble silver salts, such as silver nitrate, and water soluble halide salts, such as alkali halide salts, most commonly sodium or potassium halide salts, are introduced into the reaction chamber. In an aqueous medium the peptizer is typically a hydrophilic colloid, such as gelatin, which can be introduced with either or both of the silver and halide salts or separately therefrom. It is recognized that the silver and the halide salts can include any conventional counter ion which allows for desired solubility in the reaction medium and which is not incompatible with the silver halide grain-forming reaction. A wide variety of both aqueous and nonaqueous silver halide grain-forming double-jet reaction techniques and reactants for use therein are taught in the art. A thorough discussion of conventional silver halide precipitation reactions can be found in the following references: *Photographic Chemistry*, Pierre Glafkides, Fountain Press, London, 1958, pp. 327–330; *Nucleation in Silver Bromide Precipitation*, C. R. Berry and D. C. Skillman, J. Phys. Chem., 68, 1138–43 (1946); C. R. Berry and D. C. Skillman, J. Photo Sci., 68, 121–133 (1964); and *The Theory of the Photographic Process*, Third Edition, C. E. K. Mees and T. H. James, Macmillan, 1966, Chapter 2; Berry, *Rate Processes in AgBr Crystal Growth*, Photog. Sci. and Engr., 18, 4–8, (1974); Berry, *A New Model for Double-Jet Precipitations*, Photog. Sci. and Engr., 20, 1–4, (1976).

The construction of the jets and the vessel forming the reaction chamber can be of a type well known in double-jet silver halide precipitations. Exemplary of apparatus useful in the practice of our process is that disclosed by Porter et al U.S. Pat. No. 3,782,954, issued Jan. 1, 1974, and Frame et al, U.S. Pat. No. 3,415,650, issued Dec. 10, 1968. These reaction vessels are, of course, provided with an outlet conduit for withdrawing silver halide emulsion while silver halide grain formation is occurring.

In forming radiation-sensitive silver halide emulsions according to our process we control the total halide ion concentration within the reaction chamber. We operate at lower halide ion concentrations and, in a specifically preferred mode, nearer the equivalence point than has heretofore been taught for continuous silver halide precipitations in the presence of a ripening agent. The equivalence point represents the point at which a stoichiometric ratio of silver ion to halide ions exists within the reaction medium. The equivalence point for a given silver halide is a function of the specific halide ion and ambient temperature. By operating at lower halide ion concentrations, typically nearer the equivalence point than heretofore employed, and employing a sulfur-containing ripening agent, we can reduce the solubility of the silver halide grains in the reaction medium amd reduce the opportunity for physical (Ostwald) ripening of silver halide grains in subsequent handling. By reducing phsycial ripening after the silver halide grains are removed from the reaction chamber, the reproducibility of the silver halide grains produced from run to run using our process can be improved. Our process also allows wide control over silver halide grain size and morphology.

To operate at reduced total halide ion concentrations according to our process we monitor the pAg of the reaction medium within the reaction chamber and, by regulating the feed rates of the reactants, maintaim the total halide ion concentration within the reaction chamber at less than 0.010 molar. While it should be possible to obtain equivalent results by monitoring halide ion concentrations directly within the reaction chamber, it is as a practical matter most convenient to monitor pAg, since this is the more common art-employed measurement. As is well understood within the art, pAg is the negative logarithm (hereinafter designated log) of the silver ion concentration expressed in normality units (which for monovalent ions corresponds to moles/-liter). By regulating the pA g within the reaction chamber the relative concentration of halide ion is also regulated. Where a silver salt and a bromide salt, for example, are being introduced concurrently into the reaction chamber at a given temperature, the relationship of the silver and bromide ion concentrations can be expressed by the following equation:

$$-\log Ksp = pBr + pAg \quad (1)$$

where

*pAg* is the negative log silver ion concentration, expressed in normality units,

*pBr* is the negative log bromide ion concentration, expressed in normality units, and

*Ksp* is the solubility product constant at the temperature of reaction. The equivalence poiunt is exactly one-half the *Ksp* for a specific silver halide. The relationship between temperature and -log Ksp can be seen below in Table I.

Table 1

| Temperature° C | AgCl −log Ksp | AgI −log Ksp | AgBr −log Ksp |
|---|---|---|---|
| 40 | 9.2 | 15.2 | 11.6 |
| 50 | 8.9 | 14.6 | 11.2 |
| 60 | 8.6 | 14.1 | 10.8 |
| 70 | 8.3 | — | 10.5 |
| 80 | 8.1 | 13.2 | 10.1 |
| 90 | 7.6 | — | 9.8 |

Techniques for continuously monitoring and regulting pAg during silver halide precipitation are disclosed, for example, by Culhane et al U.S. Pat. No. 3,821,002, issued June 28, 1974, and by Claes and Peelaers, Photographische Korrespondenz, 103, 161 (1967).

It is recognized that in silver halide precipitations according to our process silver bromide, silver bromoiodide, silver iodide, silver chlorobromide, silver chloride, silver chloroiodide and silver chlorobromoiodide grains can be formed by introducing one or more halide salts separately or in combination into the reaction chamber. Where a combination of bromide and iodide salts are employed, for example, they may be introduced into the reaction chamber in separate jets or in a single jet as a mixture of halide salts. As is well recognized int he photographic arts, only a minor proportion of iodide as compared to other halide is preferred in silver haloiodide grains. Typically, iodide salt addition to the reaction chamber is restricted to maintain the iodide ion present below about 30 mole percent, based on total halide ion present. Solver bromoiodide grains having from about 0.1 to 10 mole percent iodide, based on total halide, are generally preferred.

We regulate the total halide ion concentrations of the reaction medium through control of the relative rates of the reactant introduction so that a halide ion concentration is maintained which is less than 0.010 molar. There is no reason in theory why the total halide ion concentration could not be maintained below the equivalence point of the emulsion being prepared, (that is, at a point where the silver ion concentration exceeds the total halide ion concentration) and, in fact, formation of silver halide grains by batch preparation processes in the presence of an excess of silver ions has been practiced in the art with advantageous results. We contemplate forming silver halide emulsions continuously at total halide ion concentrations below the equivalence point; however, in accordance with more common batch precipitation procedures, we prefer to form silver halide emulsions at total halide ion centrations above the equivalence point (that is, at a point here the total halide ion concentration exceeds the silver ion concentration). We specifically prefer to maintain the total halide ion concentration then in the range of from about 0.0001 to 0.01 molar.

In addition to introducing silver salt, halide salt and peptizer into the reaction chamber during continuous silver halide precipitations according to our process we additionally continuously introduce a sulfur-containing silver halide ripening agent. The ripening agent can be introduced into the reaction chamber along with any one or combination of the other materials or entirely separately, if desired.

We have found that conventional thioether ripening agents, such as those disclosed for this purpose in McBride U.S. Pat. No. 3,271,157, issued Sept. 6, 1966, here incorporated by reference, can be employed to produce regular silver halide cubes and octahedra. We contemplate introducing the thioether at a rate sufficient to produce a concentration of from 0.05 to 50 grams per mole of silver halide in the emulsion being withdrawn from the reaction chamber, with about 0.1 to 20 grams of thioether per mole of silver halide being preferred.

Certain of the preferred organic thioether silver halide solvents can be represented by the formulas:

$$Q-[(CH_2)_r-CH_2-S-(CH_2)_2-X-(R)_p-(CH_2)_2-(R')_q-S-CH_2(CH_2)_m-Z]_n$$

and $$Q-(CH_2)_m-(CH_2-S-(CH_2)_n-S-CH_2(CH_2)_r-Z$$

wherein: $r$ and $m$ are integers of 0 to 4; $n$ is an integer of 1 to 4; $p$ and $q$ are integers of 0 to 3; X is an oxygen atom (—O—), a sulfur atom (—S—), a carbamyl radical $$(-\overset{O}{\overset{\|}{C}}NH-),$$

a carbonyl radical $$(-\overset{O}{\overset{\|}{C}}-)$$

or a carboxy radical $$(-\overset{O}{\overset{\|}{C}}OH);$$

R and R' are ethylene oxide radicals ($-O-CH_2CH_2-$); Q and Z are hydroxy radicals (—OH), carboxy radicals, or alkoxy radicals (—O—alkyl) wherein the alkyl group has 1 to 5 carbon atoms; and Q and Z can also be substituents described for X linked to form a cyclic compound.

Preferred organic thioether silver halide ripening agents suitable for forming the emulsions of the invention include compounds represented by the formulas:

$$HO(-R^2-S-)_rR^2OH$$

$$(HO-R^2-S-R^2-O-R^4)_2$$

$$(R^3-O-R^2-S-R^2-\overset{O}{\overset{\|}{C}}NH-R^4-)_2,$$

$$(R^3-O-R^2-S-R^2-)_2S$$

$$(R^3-NH\overset{O}{\overset{\|}{C}}-R^2-S-R^2-)_2O \text{ and } S\begin{matrix}(R^2-O)_s-R^2\\ \\ (R^2-O)_s-R^2\end{matrix}\!\!\!

sensitized emulsions comparably prepared according to our process using thiocyanate and thioether ripening agents, we have observed higher speeds with the former. In both their primitive and chemically sensitized forms, both the thioether and thiocyanate emulsions prepared according to our process have produced speeds in excess of those produced by continuous precipitations under ammoniacal conditions, even where larger silver halide grains have been produced by ammoniacal precipitations. Thus, we consider the use of sulfur-containing silver halide ripening agents to produce generally superior results as compared to ammonia ripening of continuously precipitated silver halide emulsions. We further recognize that thiocyanate and thioether ripening agents nevertheless produce somewhat differing results.

Under steady state operating conditions the rate at which materials are introduced into and withdrawn from the reaction chamber are balanced, and there is no net change in the volume of the reaction medium within the reaction chamber. The average time that the materials stay in the reaction chamber, referred to as the residence time, is a function of the volume of the reaction medium divided by the rate of withdrawal of silver halide emulsion. The longer the residence time, the larger are the mean silver halide grain sizes in the emulsion withdrawn. Polydispersed silver halide emulsions ranging from the very coarse to very fine grain emulsions can be produced by our process. We specifically contemplate that coarse grain emulsions—i.e., those having mean silver halide grain diameters in the range of from about 0.5 to 2.0 microns or higher—can be produced using residence times of less than 20 minutes. In producing silver halide emulsions of commonly employed photographic speeds, we contemplate using residence times of from about 0.1 to 8 minutes.

In the foregoing description of our process we have referred to a single stage continuous silver halide precipitation. Our process can also be performed in plural stages. In single stage continuous silver halide precipitations according to our process the reactants are introduced into a single reaction chamber as described above and silver halide emulsion is withdrawn with no further addition to the emulsion of silver halide forming silver and halide salts being undertaken. In a two stage continuous silver halide precipitation according to our process, the first stage is performed in the same general manner described above, and the silver halide emulsion withdrawn from the first stage reaction chamber is fed to a second reaction chamber to which additional reactive silver and halide salts are being separately introduced. The first stage silver halide emulsion is preferably introduced into the second reaction chamber separately from both the additional silver and halide salts. Additional sulfur-containing ripening agent and silver halide grain peptizer can be introduced into the second reaction chamber separately from the silver halide emulsion or, alternatively, enough of these materials can be added to the first stage reaction chamber so that the proportions in the silver halide emulsion leaving the second stage reaction chamber correspond to those indicated above as being desired in the emulsion being withdrawn. The construction of the second stage reaction chamber and control of pAg in the second precipitation stage can be similar to that employed in the first precipitation stage. Additional successive precipitation stages—e.g., third, fourth, fifth, etc.—can be employed and are generally similar to the second precipitation stage described above.

We have observed distinct advantages in plural stage continuous silver halide precipitations as compared to single stage precipitations. One advantage is that for a given average overall residence time steady state operating conditions can be reached much more quickly using plural precipitation stages than when a single precipitation stage is employed alone. Additionally, we have observed that a reduced distribution of silver halide grain sizes is obtained using plural precipitation stages as compared to a single precipitation stage. In a plural stage precipitation then, although the silver halide grains remain polydispersed, the size difference between the largest and smallest grains is reduced, so that the silver halide grains more clearly approach monodispersed grain distributions.

One notable disadvantage of a continuous silver halide precipitation process as compared to a batch precipitation process is that, if reactants, peptizer and ripening agent are introduced into the first reaction chamber at start up without other steps being taken, the emulsion being withdrawn will vary in its composition until a steady state operating condition is eventually obtained. Since the emulsion obtained during the start up differs in composition from the emulsion finally obtained under steady state precipitation conditions, it may or may not be useful as an end product. Generally, it is preferred to use the emulsions produced by our process only after a desired steady state condition is reached and, in any event, to separate these emulsions from those of variable composition produced during start up. In the absence of corrective measures, several residence times (typically 6 to 10) are required to reach steady state operating conditions.

As indicated above, the number of residence times required to reach a constant emulsion output after start up can be reduced by using plural serial emulsion precipitation stages. We have also observed that the number of residence times required to reach steady state can be reduced by seeding a reaction chamber at start up with an emulsion containing silver halide grains. The silver halide grains should preferably correspond in composition to those sought to be produced and can be of any convenient size. Generally the more nearly the silver halide grains used for seeding approach the desired steady state silver halide grains, the quicker steady state conditions will be reached. For example, by saving a portion of the emulsion leaving a reaction chamber at steady state operating conditions and using this emulsion as a seeding material during the next start up, precipitation according to our process can begin at or very close to steady state conditions. Generally using silver halide grains for seeding up to the size of the silver halide grains desired in the emulsion leaving the reaction chamber is preferred. Where plural serial precipitation stages are employed, it is generally preferred to seed all of the reaction chambers at start up; but where less than all the reaction chambers are seeded, it is necessary that the earlier stage reaction chambers be seeded in order to accelerate reaching steady state conditions. In an optimum arrangement for plural stage precipitations a portion of the steady state output from each stage is saved and returned to that stage for seeding purposes during subsequent start up. From the foregoing, it is apparent that the disadvantage of delayed production of a uniform silver halide emulsion can be effectively obviated.

Any conventional silver halide peptizer can be employed in the practice of our process. A variety of conventional silver halide peptizers are disclosed, for example, in *Product Licensing Index*, Vol. 92, December 1971, publication 9232, paragraph VIII. Where aqueous silver halide precipitations are contemplated, hydrophilic colloid peptizers are preferred. Gelatin represents a preferred peptizer. Typically gelatin is employed as a peptizer in concentrations from about 0.2 to 10 percent by weight of the silver halide emulsion being produced, most preferably in concentrations from about 0.4 to 5 percent by weight. Exemplary of other preferred polymeric materials which can be used in place of gelatin and gelatin derivatives are materials such as poly(vinyl alcohol), poly(vinylpyrrolidone), polyacrylamides and the copolymers described in U.S. Pat. Nos. 3,692,753 and 3,813,251.

The silver halide emulsions produced according to our process can form latent images predominantly on the surface of the silver halide grains or predominantly on the interior of the silver halide grains. The properties of the silver halide emulsions can be altered, for example, by introduction of metal dopants in the reaction medium. Typically preferred metal dopants are Group VIII elements having an atomic weight greater than 100, such as ruthenium, rhodium, palladium, osmium, iridium and platinum. The use of metal dopants of this type are disclosed, for example, by Smith and Trivelli U.S. Pat. No. 2,448,060, issued Aug. 31, 1948, Berriman U.S. Pat. No. 3,367,778, issued Feb. 6, 1968; Wise U.S. Pat. No. 3,537,858, issued Nov. 3, 1970; and Evans U.S. Pat. No. 3,761,276, issued Sept. 25, 1973.

Upon withdrawal of silver halide emulsion from the reaction chamber (or the last serial reaction chamber), further preparation and use can be carried out according to procedures well known in the art in connection with batch prepared silver halide emulsions of similar composition and grain size. The emulsions are, of course, generally useful in forming conventional silver halide photographic elements similarly as comparable batch prepared silver halide emulsions.

In a specifically preferred form the emulsions formed according to our process are chemically sensitized. Chemical sensitization is most commonly achieved using noble metal and/or middle chalcogen sensitizers. Conventional techniques for achieving noble metal and/or middle chalcogen sensitization are those contained in Sheppard U.S. Pat. Nos. 1,574,944, issued Mar. 2, 1926 and U.S. Pat. No. 1,623,499, issued Apr. 5, 1927; Sheppard et al. U.S. Pat. No. 2,410,689, issued Nov. 5, 1947; Waller et al. U.S. Pat. No. 2,399,083, issued Apr. 23, 1946; Smith et al. U.S. Pat. No. 2,448,060, issued Aug. 31, 1948; Baldesiefen U.S. Pat. Nos. 2,540,085 and 2,540,086, both issued Aug. 31, 1948; Damschroder at al. U.S. Pat. No. 2,597,856, issued May 27, 1952; Damschroder et al. U.S. Pat. No. 2,642,361, issued June 16, 1953; Dunn U.S. Pat. No. 3,297,446, issued Jan. 10, 1967; McVeigh U.S. Pat. No. 3,297,447, issued Jan. 19, 1967; McVeigh U.S. Pat. Nos. 3,408,196 and 3,408,197, both issued Oct. 29, 1968; and Millikan et al. U.S. Pat. No. 3,753,721, issued Aug. 21, 1973. A continuous process for chemical sensitization is described in U.S. Pat. No. 3,827,888, issued Mar. 6, 1972.

As is illustrated by the above patents, a variety of sulfur, selenium and tellurium compounds can be employed as middle chalcogen sensitizers. Typical sulfur sensitizers include compounds such as allyl thiourea, allyl isothiocyanate, phenyl isothiocyanate, phenyl thiourea, carbanilide, thiourea, thiosemicarbazide, sodium, potassium or ammonium thiosulfate, thioacetamide, thioformamide, thiobarbituric acid and diacetylthiourea. Typical selenium sensitizers include compounds such as allyl isoselenocyanate, potassium selenocyanide, allyl selenourea and labile selenium compounds such as colloidal selenium, selenoacetone, selenoacetophenone, tetramethylselenourea, N-(β-carboxyethyl)-N',N'-dimethyl selenourea, selenoacetamide, diethylselenide, triphenylphosphine selenide, tri-p-tolylselenophosphate, tri-n-butylselenophosphate, 2-selenoproponic acid, 3-selenobutyric acid, methyl-3-selenobutyrate, allyl isoselenocyanate and dioctylselenourea. Typical tellurium compounds include allyl isotellurocyanate, potassium tellurocyandide, allyl tellurorea and diacetylthiourea. Other conventional middle chalcogen sensitizers can, of course, be employed. In those instances where an active gelatin is employed in forming the photographic silver halide emulsion no further middle chalcogen sensitization is required.

The nobel metal sensitizers typically take the form of salts of gold or Group VIII noble metals, such as ruthenium, rhodium, palladium, iridium, osmium and platinum. Among the noble metal compounds typically employed are compounds such as ammonium and potassium chloropalladate, ammonium, sodium and potassium chloroplatinate, ammonium, potassium and sodium bromoplatinate, ammonium chlororhodate, ammonium chlororuthenate, ammonium chloroiridate, ammonium, potassium and sodium chloroplatinate, ammonium, potassium and sodium chloropalladite, etc. Illustrative gold sensitizers include chloro-potassium aurate, potassium auriaurite, potassium auricyanaide, potassium aurithiocyanate, gold sulfide, gold selenide, gold iodide, potassium chloroaurate, ethylenediamine-bis-gold chloride and various organic gold compounds structurally shown in U.S. Pat. No. 3,753,721, issued Aug. 21, 1973.

While the chemical sensitizers can be added to photographic silver halide emulsions in any conventional manner, it is generally preferred to add the sensitizers concurrently to the emulsions after the silver halide grains thereof have been fully formed. The chemical sensitizers can be added in the form of their aqueous solutions where they are soluble in water or in an innocuous organic solvent where the sensitizer does not have sufficient solubility in water to be used in the form of an aqueous solution. Particularly useful organic solvents include ethanol, methanol, pyridine, acetone, dioxane, etc. That is, organic solvents which have a rather high degree of polarity are usually preferred. Where it is desired to add the sensitizers in some other form than solution, this procedure is also possible, especially where the sensitizers are available in the form of a colloidal suspension. In some cases, it is possible to add the sensitizers suspended in an organic solvent which forms very small suspended particles or oil globules in the photographic emulsion similar to the type of particles produced in preparing coupler dispersions as described in Jelley et al U.S. Pat. No. 2,322,027, issued June 15, 1943 and Fierke et al U.S. Pat. No. 2,801,171, issued July 30, 1957. Dispersing media useful for this purpose include tricresyl phosphate, dibutyl phthalate, triphenyl phosphate, etc.

The degree to which a photographic silver halide emulsion is sensitized by a middle chalcogen or noble metal sensitizer is a function not only of the quantity of sensitizer added to the emulsion, but also of the time and temperature of digestion following addition of the sensitizer. In sensitizing the emulsions formed in the practice of our invention we prefer to add concurrently the middle chalcogen and noble metal sensitizers after the silver halide grains of the emulsion are fully formed. In this way we can control the degree of sensitization by each sensitizer by controlling the amount of sensitizer added. The concentration of each sensitizer can be varied depending upon the contrast desired in the final product, the specific sensitizer employed and the photographic speed desired. Typically middle chalcogen sensitizers have been found to be effective in amounts ranging from trace concentrations to 15 mg per mole of silver or more. Preferred concentrations of middle chalcogen sensitizers are typically from 0.1 to 10 mg per mole of silver. Typically noble metal sensitizers are employed in somewhat higher concentrations ranging from about 2 to 5 times that of the middle chalcogen sensitizer. Preferred concentrations of metal sensitizers typically range from about 1 to 40 mg per mole of silver, most preferably from about 2 to 20 mg per mole of silver. It is possible to wash excess sensitizer from the emulsion after digestion of the emulsion.

Other exemplary conventional treatments for the silver halide emulsions can be illustrated by reference to 92 PLI 9232, cited above, pp. 107 through 110. The continuously precipitated emulsions can, for example, be washed to remove soluble salts as described on p. 107, paragraph II, "Emulsion Washing" or by ultrafiltration washing as described in *Research Disclosure* No. 10208 (Oct. 1972). They can be spectrally sensitized with dyes or combinations thereof as described on pp. 108–109, paragraph XV, "Spectral sensitization", of the above article. They can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating Aids", of the above article; they and other associated layers in photographic elements can contain developing agents, plasticizers, vehicles and filter dyes described on p. 107, paragraph VI, "Developing agents", p. 108, paragraph XI, "Plasticizers and lubricants", and paragraph VIII, "Vehicles", and p. 109, paragraph XVI, "Absorbing and filter dyes", of the above article. They and other layers in photographic elements may contain addenda which are incorporated by using the procedures described on p. 109, paragraph XVII, "Methods of addition", of the above article; and they can be coated using the various techniques described on p. 109, paragraph XVIII, "Coating procedures", on any of the supports described on p. 108, paragraph X, "Supports". Elements containing the above continuously precipitated emulsions can be used in any photographic material sensitive to any kind of electromagnetic radiation to which silver halide is sensitive or can be sensitized to the same extent as comparable batch-prepared emulsions. Among these are color materials, such as those described on p. 110 of the above reference, paragraph XXII, and black-and-white materials which can be either wet- or solution-processed, such as described on p. 110, paragraph XXIII. Suitable emulsions prepared in the above manner can also be used in dry-development, physical development, or direct print processes, as described on pp. 109-110, paragraph XX, "Dry development systems", paragraph XXI, "Physical development systems", and paragraph XXV, "Direct print and print-out". The emulsions can be used for either back-and-white or color image transfer processes such as described on p. 109, paragraph XIX, "Image transfer systems."

The following examples further illustrate the practice of our invention.

A reaction vessel of the type disclosed in Frame and Johnson U.S. Pat. No. 3,415,650 was charged with 1200 ml of a 2.88 percent by weight aqueous solution of gelatin. The following three solutions were simultaneously added through separate inlets into the reactor, which was maintained at 80° C:

A. 4.0 M silver nitrate at 20 ml/min.
B. 4.0 M sodium bromide at 20 ml/min.
C. 2.88 percent by weight gelatin solution at 200 ml/min.

The silver halide emulsion produced was continuously removed from the vessel at 240 ml/min., while maintaining a constant volume in the reactor and a residence time of 5 minutes.

Each emulsion sample was coated at 2.9 g/m² silver and 9.7 g/m² gelatin on a cellulose acetate film support. Each sample was exposed to a tungsten light source in a Eastman 1B sensitometer. The coatings were developed 5 minutes in Kodak DK-50 developer, fixed, washed and dried.

1. Comparisons Illustrating the Effects of Silver Halide Ripening Agents

In the various runs reported in Table II a sample was taken from the emulsion after steady state conditions had been reached. Emulsion samples were taken within from about 11 to 16 residence times from start up. The emulsion samples were coated both as primitive emulsions and as optimally sulfur and gold sensitized emulsions.

The individual samples differed in the ripening agent employed as indicated in Table II below. Sodium thiocyanate was employed as the thiocyanate ripening agent while 1,10-dithia-4,7,13,16-tetraoxacyclooctadecane was employed as the thioether ripening agent. In each instance the ripening agent employed was mixed with the peptizer introduced into the reaction chamber.

Table II

| | Ripening Agent conc. (Moles) | pAg | Molar Br Ion Conc. (pBr) | Primitive Emulsion Relative Speed | Primitive Emulsion Contrast | Primitive Emulsion Fog | Optimally S + Au-Sensitized Emulsion Relative Speed | Optimally S + Au-Sensitized Emulsion Contrast | Optimally S + Au-Sensitized Emulsion Fog |
|---|---|---|---|---|---|---|---|---|---|
| Controls 1-1A | ammonia 1.3M | 6.85 | 0.00056 (3.25) | no image | discrim. | 1.00 | no image | discrim | 0.96* |
| Controls 2-2A | ammonia 0.66M | 6.85 | 0.00056 (3.25) | 912 | 0.65 | 0.06 | no image | discrim. | 1.00* |
| Controls 3.3A | ammonia 0.66M | 8.30 | 0.016~ (1.80) | 74 | 0.19 | 0.04 | image | discrim <0.3 | 0.12 |
| Controls 4-4A | ammonia 0.66M | | uncontrolled | no image | discrim. | 0.04 | 2340 | 0.60 | 0.12 |

Table II-continued

| | Ripening Agent conc. (Moles) | pAg | Molar Br Ion Conc. (pBr) | Primitive Emulsion Relative Speed | Contrast | Fog | Optimally S + Au-Sensitized Emulsion Relative Speed | Contrast | Fog |
|---|---|---|---|---|---|---|---|---|---|
| Controls 5-5A | none | 6.85 | 0.00056 (3.25) | 100 | 1.46 | 0.03 | 1480 | 1.50 | 0.07 |
| Examples 1-1A | thioether 0.0004M | 6.85 | 0.00056 (3.25) | 355 | 1.12 | 0.03 | 3800 | 1.17 | 0.11 |
| Examples 2-2A | thiocyanate 0.037M | 6.85 | 0.00056 (3.25) | 251 | 0.49 | 0.03 | 5500 | 0.74 | 0.11 |

*Fog at all times and at all levels of sensitizers used.

The excess bromide ion concentration within the reaction chamber was controlled by monitoring and regulating pAg using an apparatus similar to that described by Culhane et al U.S. Pat. No. 3,821,002, issued June 28, 1974.

Referring to Table II, it can be seen that no useful photographic results were obtained with Control 1, a primitive ammonia ripened emulsion or Control 1A, a similar emulsion, which was sulfur and gold sensitized. Control 2, a primitive ammonia ripened emulsion, exhibited a relatively high speed for a primitive emulsion, but exhibited a contrast of only 0.65. Comparable Control 2A, which differed by being sulfur and gold sensitized, produced no useful photographic results. It is to be noted that Control 2 was formed using a 0.00056 molar bromide ion concentration, whereas it has heretofore been taught in the art to use higher bromide ion concentrations in continuously forming ammonia ripened emulsions. Controls 3 and 3A show the results when high bromide ion concentrations as taught in the art are employed. Control 3, a primitive emulsion, exhibited a comparatively low speed and contrast, while Control 3A, which differed by chemical sensitization, produced no useful photographic results. Controls 4 and 4A show that failure to control bromide ion concentration resulted in a primitive emulsion which failed to produce useful photographic results, although useful results were obtained when the same emulsion was sulfur and gold sensitized. Controls 5 and 5A show that in the absence of a ripening agent, but with control of bromide ion concentration, a useful primitive emulsion is produced as well as a useful sulfur and gold sensitized emulsion.

Comparing the photographic properties of the thioether ripened emulsions formed according to our process with those of the controls, it can be seen that the primitive thioether ripened emulsion of Example 1 exhibited a speed higher than that of any of the primitive controls, except the ammonia ripened Control 2, and a higher contrast than any of the ammonia ripened controls. The thioether ripened, sulfur and gold sensitized emulsion of Example 1A exhibited a higher speed than any of the controls and a higher contrast than any of the ammonia ripened controls. The thioether ripened emulsions exhibited regular cubic grains.

The thiocyanate ripened emulsions of Examples 2 and 2A also demonstrated distinct advantages over the controls. The primitive thiocyanate ripened emulsion of Example 2 exhibited a higher speed and contrast than any of the ammonia ripened primitive emulsions, except Control 2. The thiocyanate ripened primitive emulsion was somewhat slower and of lower contrast than the corresponding primitive thioether ripened emulsion. When the thiocyanate ripened emulsion was sulfur and gold sensitized, it produced the highest obtained photographic speed of all the emuulsions prepared. The contrast of the sensitized, thiocyanate ripened emulsion remained somewhat lower than the contrast of the comparable thioether ripened emulsion, but higher than the contrast obtained by ammonia ripened, sulfur and gold sensitized Control 4A.

2. An Illustration of the Effect of Cascade Precipitations

A procedure was follower similar to that described above, except that two reaction vessels were arranged in a cascade relationship, so that the emulsion withdrawn from the first reaction vessel was employed as a feed stock for the second reaction vessel. In addition to emulsion from the first reaction vessel silver and bromide salts were separately added to the second reaction vessel. The rate of reactant introduction to each stage was controlled to give a residence time of 2 minutes 30 seconds in each stage or 5 minutes residence overall. Only 5 residence times (25 minutes) were required to achieve steady state as compared to about 8 to 9 residence times for comparable single stage precipitations. Cubic grains were produced which were of narrower grain size distribution than for comparable single stage precipitation. The two stage precipitation produced smaller mean grain sizes. Useful photographic speeds were observed with minimum densities being about 0.04.

3. An Illustration of the Effect of Seeding on Start Up

Using a procedure similar to that described under heading 1 above, approximately 8 residence times were required to achieve a steady state size-frequency distribution of silver halide grains in the emulsion withdrawn from the reaction vessel. When the reaction vessel was charged at start up with 1200 ml of a monodispersed cubic silver bromide emulsion having 0.04 mole of 0.07 micron silver bromide grains, only 5 residence times were required to reach steady state operating conditions. When the reaction vessel was charged with an emulsion taken from a previous run at approximately 9 residence times, it was found that steady state conditions were achieved in the reaction vessel immediately upon start up. The above determinations of steady state conditions were made by viewing the size-frequency distribution of silver halide grains withdrawn at various residence times. An invariant size-frequency distribution was considered indicative of steady state operating conditions.

The invention has been described with particular reference to preferred embodiment thereof but it will be understood that variations and modifications can be effected within the spirit and scope of the invention.

We claim:

1. In a process of continuously preparing a radiation-sensitive silver halide emulsion wherein 1. a silver salt and a halide salt capable of reacting to form radiation-sensitive silver halide grains are concurrently and separately continuously introduced into a reaction chamber in the presence of a peptizer and 2. radiation-sensitive silver halide emulsion is withdrawn continuously from the reaction chamber while silver halide grain formation is occurring under steady state operating conditions, the improvement comprising forming the silver halide grains in the presence of a sulfur-containing ripening agent chosen from the group consisting of thioether and thiocyanate ripening agents for silver halide grains, and concurrently controlling and maintaining the total halide ion concentration at less than 0.01 molar.

2. A process according to claim 1 wherein a stoichiometric excess of halide ions as compared to silver ions is maintained.

3. A process according to claim 2 wherein the total halide ion concentration in the reaction chamber is maintained and controlled at from 0.0001 to 0.01 molar.

4. A process according to claim 1 wherein the halide salt introduced into the reaction chamber is comprised of a bromide salt capable of reacting with the silver salt to form a silver bromide.

5. A process according to claim 4 wherein an iodide salt is introduced into the reaction chamber concurrently with the bromide salt in an amount sufficient to produce a silver bromoiodide emulsion having up to 30 mole percent iodide.

6. A process according to claim 1 wherein the silver halide emulsion is sulfur sensitized following removal from the reaction chamber.

7. A process according to claim 1 wherein the silver halide emulsion is gold sensitized following removal from the reaction chamber.

8. A process according to claim 1 wherein the silver halide emulsion is formed in a plurality of serially related reaction chambers, wherein the silver halide emulsion withdrawn from one reaction chamber is used as one feed stock for a second reaction chamber.

9. A process according to claim 1 wherein silver halide grains are present in the reaction chamber at commencement of silver halide precipitation, so that the times required to reach steady state operating conditions is reduced.

10. In a process of continuously preparing a radiation-sensitive silver bromide emulsion wherein 1. a silver salt and a bromide salt capable of reacting to form radiation-sensitive silver bromide grains are concurrently and separately introduced continuously into a reaction chamber in the presence of gelatin,
2. radiation-sensitive silver bromide emulsion is withdrawn continuously from the reaction chamber while silver bromide grain formation is occurring, under steady state operating conditions and
3. thereafter chemically sensitizing the emulsion following removal from the reaction chamber, the improvement comprising forming the silver bromide grains in the presence of a thioether ripening agent for silver bromide grains and concurrently maintaining and controlling the bromide ion concentration in the reaction chamber so that at least a stoichiometric excess of bromide ions as compared to silver ions and less than a 0.010 molar concentration of bromide ions is present.

11. A process according to claim 10 wherein the emulsion is sulfur sensitized following removal from the reaction chamber.

12. A process according to claim 10 wherein the emulsion is gold sensitized following removal from the reaction chamber.

13. A process according to claim 10 wherein the emulsion is sulfur and gold sensitized following removal from the reaction chamber.

14. A process according to claim 10 wherein the bromide ions are present in the reaction chamber in a concentration of from 0.0001 to 0.010 molar.

15. In a process of continuously preparing a radiation-sensitive silver bromide emulsion wherein 1. a silver salt and a bromide salt capable of reacting to form radiation-sensitive silver bromide grains are concurrently and separately introduced continuously into a reaction chamber in the presence of gelatin,
2. radiation-sensitive silver bromide emulsion is withdrawn continuously from the reaction chamber while silver bromide grain formation is occurring, under steady operating conditions and
3. thereafter chemically sensitizing the emulsion following removal from the reaction chamber, the improvement comprising forming the silver bromide grains in the presence of a thiocyanate silver bromide grain ripening agent and concurrently maintaining and controlling the bromide ion concentration within the reaction chamber so that at least a stoichiometric excess of bromide ions as compared to silver ions is present and less than a 0.010 molar concentration of bromide ions is present.

16. A process according to claim 15 wherein the emulsion is sulfur sensitized following removal from the reaction chamber.

17. A process according to claim 15 wherein the emulsion is gold sensitized following removal from the reaction chamber.

18. A process according to claim 15 wherein the emulsion is sulfur and gold sensitized following removal from the reaction chamber.

19. A process according to claim 15 wherein the bromide ions are present in the reaction chamber in a concentration of from 0.0001 to 0.010 molar.

* * * * *